United States Patent [19]

Vanderwal, Jr. et al.

[11] Patent Number: 4,827,674

[45] Date of Patent: May 9, 1989

[54] WORKPIECE GRIPPER AND SUPPORT

[75] Inventors: Frank E. Vanderwal, Jr.; Robert M. Sunnen, both of Frontenac, Mo.

[73] Assignee: Sunnen Products Company, St. Louis, Mo.

[21] Appl. No.: 98,690

[22] Filed: Sep. 21, 1987

[51] Int. Cl.[4] ..... B24B 41/06

[52] U.S. Cl. ..... 51/217 R; 51/277; 51/290

[58] Field of Search ..... 51/217 R, 236, 237 R, 51/277, 290, 154, 34 R, 72 R; 269/130, 131, 132

[56] References Cited

U.S. PATENT DOCUMENTS 3,292,922 11/1966 Nastev ..... 269/131
3,584,860 6/1971 Ervin ..... 269/131

FOREIGN PATENT DOCUMENTS 2823573 12/1979 Fed. Rep. of Germany ..... 269/130

*Primary Examiner*—Frederick R. Schmidt
*Assistant Examiner*—Lawrence Cruz
*Attorney, Agent, or Firm*—Haverstock, Garrett & Roberts

[57] ABSTRACT

A device for gripping and holding workpieces while they are being worked on by a machine tool or like device including a support structure, a flexible band having first and second opposite ends, a first assembly mounted on the support structure and having a mechanism thereon for attaching to one end of the flexible band and a second assembly on the support structure spaced from the first assembly and having a mechanism thereon for attaching to the second opposite end of the flexible band, at least one of the first and second assemblies being positioned on the support structure for pivotal movement whereby the opposite band ends are moved relative to each other to form a band loop in one position for receiving a workpiece to be gripped and supported and to another position to grip and support a workpiece positioned in the space defined by the band, and apparatus associated with one of the assemblies for maintaining the band engaged with the workpiece while the workpiece is being worked on.

16 Claims, 5 Drawing Sheets

WORKPIECE GRIPPER AND SUPPORT

BACKGROUND OF THE INVENTION

There are many types of machine operations which require that a workpiece be accurately and firmly held during operation thereon preferably by means which do not damage or mar the workpiece. The holding means must also be strong enough to prevent twisting and other movements of a workpiece, which movements could be created by torque acting on the workpiece which, if strong enough, might cause undesirable rotation and twisting of the working member and the tool working thereon such as a rotating machine tool, a honing mandrel or similar device. Also, the workpiece holder means must be so constructed as to be able to receive and clamp on the workpiece, preferrably while the workpiece is aligned with the tool. No known device has all of these capabilities and furthermore no known workpiece gripping and holding device is able to automatically receive workpieces fed thereto such as by means of a loading and feeding device such as disclosed in copending Sunnen et al U.S. patent application Ser. No. 098,549, filed Sept. 21, 1987.

Furthermore, known prior art gripping and holding devices are unable to be adjusted to accommodate workpieces of different sizes, and in some cases, shapes and to grip them in a manner which does not damage them or mar their surfaces, and known devices are relatively complicated and are vulnerable to excessive torque conditions which can produce damage to the workpieces and to the tool and can produce inaccuracies in the surfaces being worked on such as surfaces being honed as by twisting or bending of the working member or the tool or both when the workpiece is under load. Robotic devices likewise do not solve these problems.

SUMMARY OF THE INVENTION

The subject device is a relatively simple workpiece gripping and holding device which can be easily and quickly installed on a machine tool such as on a honing device and which is relatively easy to adjust to accommodate different size workpieces and which grips the workpieces in such a manner as to withstand substantial torque without yielding and without permitting the workpiece to rotate or otherwise move. The subject device includes means for supporting an elongated flexible strap or band member having means on one end for anchoring the strap member and means on the opposite end which also anchors and supports the strap member and is adjustable to change relative positions of the strap ends in order to clamp on to or off of workpieces of varying sizes to be gripped and supported thereby. Both ends of the strap member are adjustable, but at least one end of the strap member must be adjustable to change the effective strap or band length to accommodate workpieces of different sizes. The strap or band member also preferably has a high friction surface such as that provided by an abrasive coating formed on the workpiece engaging surface thereof to prevent the workpiece from moving relative thereto when supported under load. The device can be used to grip and hold workpieces at any orientation including in vertical and horizontal orientations.

It is a principal object of the present invention to support a workpiece and keep it from rotating or twisting when subjected to the torque produced thereon by a machine tool such as a honing machine having a honing mandrel engageable under load with the workpiece.

Another object is to teach the construction of a self-energizing workpiece gripping device which is constructed to provide gripping force that is proportional to the amount of torque applied to the workpiece but is designed to apply no more gripping force than is required for the particular operation.

Another object is to distribute the force applied to a workpiece being gripped and supported over a relatively large portion of the workpiece during an operation thereon and minimize distortion thereof.

Another object is to provide means for gripping and holding a workpiece during an operation thereon and without changing the position or orientation of the workpiece.

Another object is to enable releasing a workpiece being gripped and held during a machining operation thereon without changing its position or orientation.

Another object is to relatively easily and conveniently adjust a band used in a workpiece holding device to accommodate a range of workpiece diameters.

Another object is to provide means having a relatively high friction surface for gripping a workpiece to increase the gripping ability thereof and prevent movement of the workpiece.

Another object is to provide a workpiece gripping and holding device that requires relatively little force to maintain the workpiece in its gripped and held position.

Another object is to provide a workpiece gripping device which can be operated remotely through a hydraulic or air cylinder or like device thereby enabling the subject gripping and holding device to be used in equipment that automatically load and unload workpieces in a machine tool.

Another object is to provide means for gripping a workpiece with sufficient force to overcome stroking as well as rotational forces produced by mandrels or like devices used to hone or machine workpieces.

Another object is to provide a relatively simple, inexpensive and easy to operate workpiece gripping and holding device.

Another object is to provide a workpiece gripping and holding device which can be relatively easily installed and removed on a support structure therefor located adjacent to a machine tool such as adjacent to a honing mandrel or like device.

Another object is to make it possible to replace workpiece holding devices adjusted to accommodate different size workpieces in an efficient and simple manner.

Another object is to provide support means for a workpiece gripping and holding device which can also be made to accommodate other type gripping and holding devices of a more conventional construction.

Another object is to provide resilient detent roller means in a workpiece holding device to allow radial float which permits some eccentric tool rotation and improves hole geometry.

These and other objects and advantages of the present invention will become apparent after considering the following detailed specification which shows and describes a preferred embodiment of the subject device in conjunction with the accompanying drawings, wherein:

DETAILED DESCRIPTION OF PREFERRED EMBODIMENT

Figure 1:
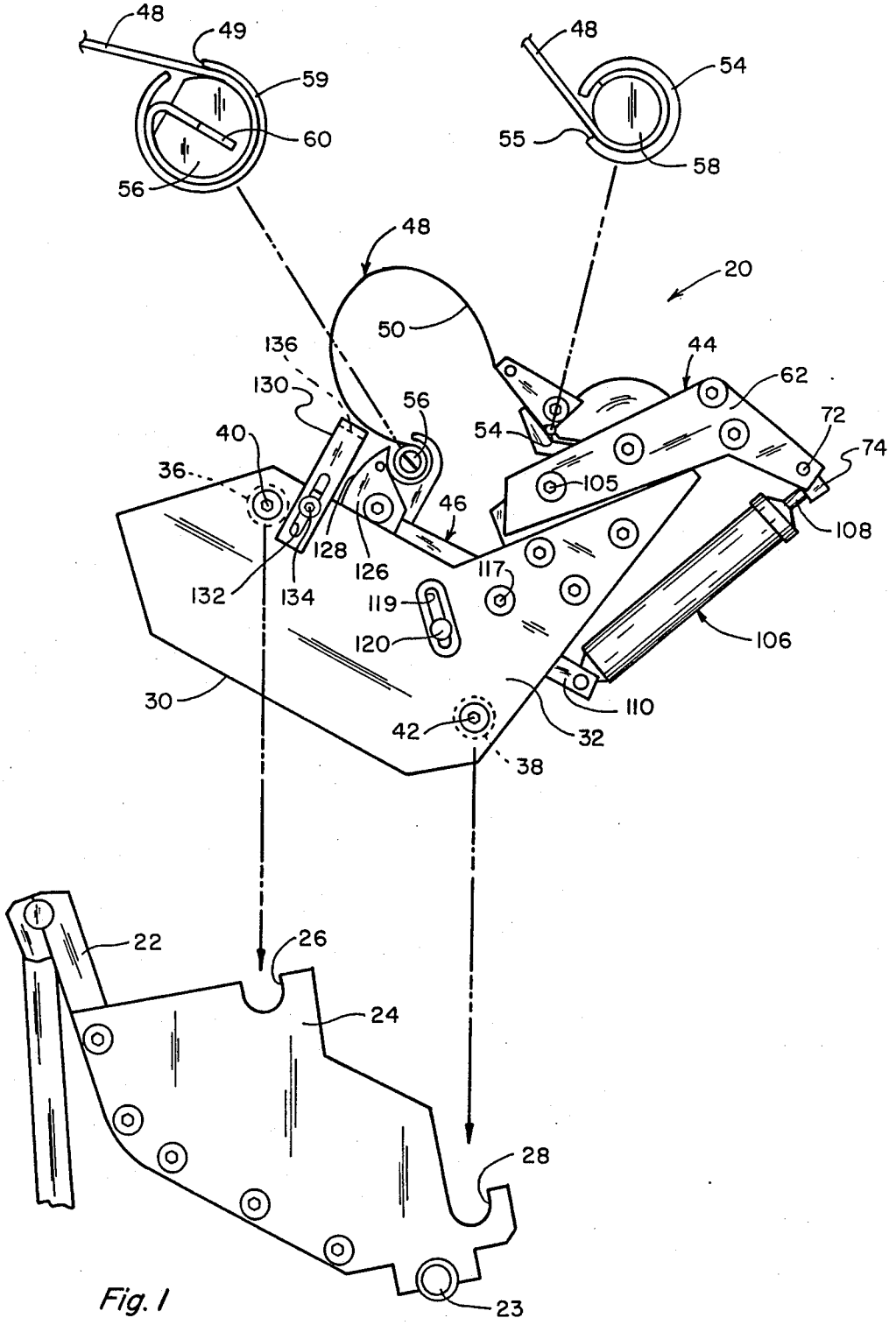
FIG. 1 is a side elevational view of a workpiece gripping and holding device and the support means therefor constructed according to the teachings of the present invention, said view including enlarged breakout views showing the details of the construction of the ends of the gripping band.

Referring to the drawings more particularly by reference numbers, number 20 in FIG. 1 identifies a workpiece gripping, holding and supporting assembly constructed according to the teachings of the present invention. The assembly 20 includes a fixed support structure 22 mounted on a machine tool such as on a honing machine or the like. The structure may include an ejection cam 23 if desired for ease of removal. The support structure 22 is generally constructed to move axially during machine operation to stroke a workpiece being held and includes a wall member 24 which has a pair of spaced open sided grooves or slots 26 and 28. The slots 26 and 28 are shown round bottomed and parallel to receive mounting and locating members located on an assembly 30 which includes spaced plates 32 and 34 (see FIG. 8) which are connected together by means which include spaced locating washers 36 and 38. The locating washers 36 and 38 are mounted between the plates 32 and 34 by means of studs 40 and 42 respectively as shown in FIG. 1 and the washers may be resilient washers and are positioned in the respective slots 26 and 28.

Referring again to FIG. 1 there is shown mounted on the structure 30 a relatively fixed jaw assembly 44 which is allowed limited angular movement as will be explained, and a movable jaw assembly 46 which is allowed much greater angular movement. The fixed and movable jaw assemblies 44 and 46 are connected by a flexible strap or band 48 which has an inner surface 50 which is the surface that is wrapped around and engages a substantial portion of the outer surface of a workpiece 52 (FIG. 2) to hold the workpiece in position while is it worked on as will be explained. The arrow in the workpiece 52 indicates the direction of tool rotation. The inner surface 50 may be formed on the band 48 as a layer of high friction material such as particles of a hard wear resistant material. Such a layer can be formed, for example, of particles of diamond or cubic boron nitride plated or otherwise applied thereto. The strap 48 has a roll pin 54 (breakout in FIG. 1) attached extending transversely across one end thereof and a cylindrical hub 56 (breakout in FIG. 1) attached extending transversely across the opposite end thereof. In the case of the roll pin 54, the band 48 is attached thereto by inserting a portion of the end of the band into a slot 55 which allows the end portion of the band to curve around the inner surface of the roll pin 54. The strap is then secured to the roll pin 54 by applying a suitable adhesive material such as an epoxy cement after which a locking pin 58 is forced into the end portion of the band to expand the band 48 into engagement with the roll pin 54 to complete the assembly, and for security reasons to maintain the band engaged with the roll pin 54. The opposite end of the band 48 is similarly mounted in a larger roll pin 59 into which the cylindrical hub 56 is forced. The roll pin 59 also has a slot 49 for receiving an end portion of the band 48 in a somewhat similar manner to the way in which the opposite end of the band is attached to the roll pin 54, and the hub member 56 has means thereon such as screwdriver slot 60 which enables the hub to be rotated when this end of the band 48 is installed in a holder as will be explained to enable adjustment of the effective operating length of the band 48 and to take out looseness in the band 48, if necessary. Adjustment in this way also enables the band to be able to accommodate workpieces of different size which are to be engaged and supported. In this way the same band 48 can be used to hold a relatively wide range of workpiece diameters. The use of a screwdriver slot is an optional feature since it is equally possible to provide an opening for receiving an Allen wrench or a hex head to accommodate an open or closed end wrench.

Figure 2:
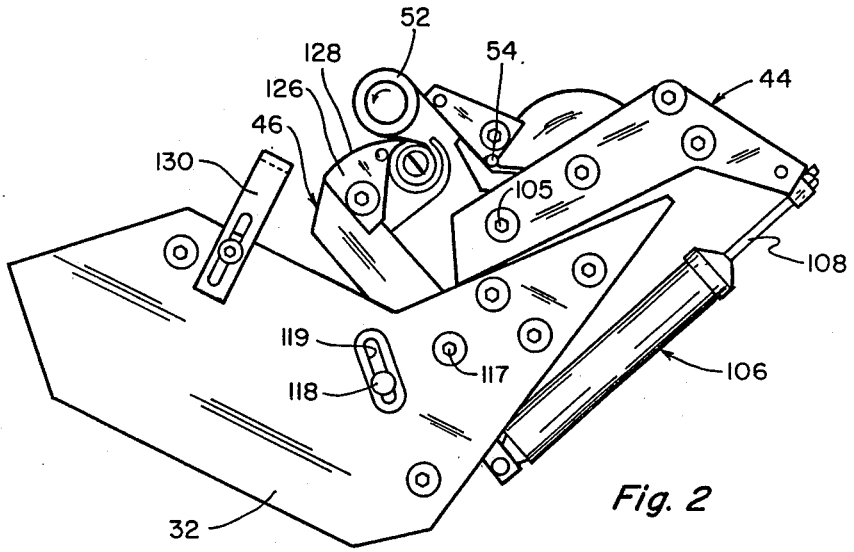
FIG. 2 is a view similar to FIG. 1 but showing the device in a workpiece gripping condition.
Figure 4:
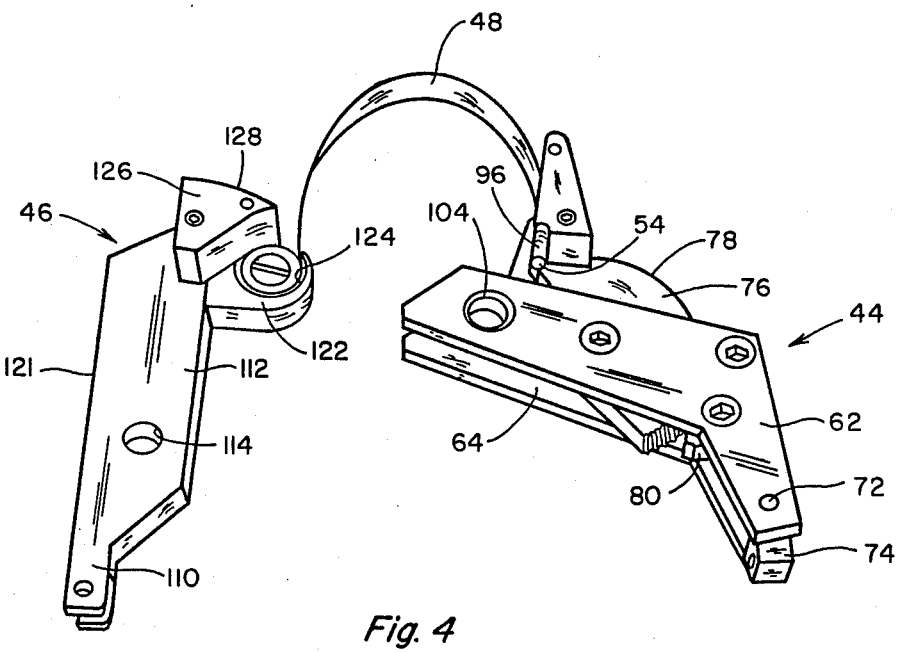
FIG. 4 is an enlarged perspective view of the fixed and movable jaw of the subject device.
Figure 6:
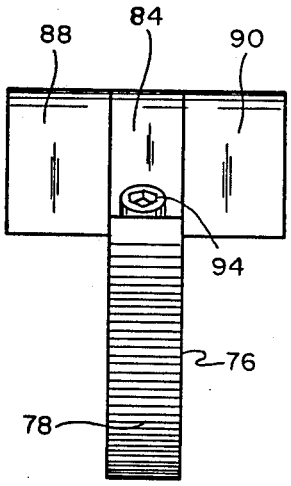
FIG. 6. is a right side elevational view of the assembly as shown FIG. 5.
Figure 7:
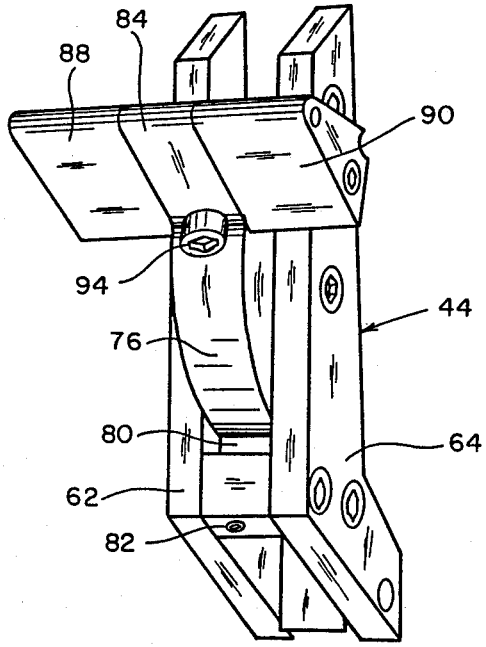
FIG. 7 is a perspective view of the fixed band assembly as seen from the right side of the assembly in FIG. 4.

Both of the assemblies 44 and 46 are mounted on the assembly 30 as shown in FIGS. 1 and 2 by means which are mounted on and extend into the space between the spaced assembly plates 32 and 34. More of the details of the individual assemblies 44 and 46 are shown in FIG. 4 where it can be seen that the assembly 44 includes a pair of spaced plates 62 and 64 which are connected by threaded connector members 66, 68, and 70 which extend therebetween. The plates 62 and 64 are also connected by a pin 72 which extends through an opening in a trunion 74 which will be described later in connection with the means for operating the subject device. Also, mounted between the plates 62 and 64 is a serrated segment member 76 which is mounted for angular movement therebetween by means that include the threaded member 70. The member 76 has an outer surface which has serrated teeth 78 (FIG. 6) any one of which can be made to cooperate with a pawl 80 (FIG. 4) located on a member that extends between the plates 62 and 64. The pawl 80 is adjustable to move into engagement with a selected tooth 78 which locks the member 76 in any desired setting position as will be explained. Referring to FIG. 7 there is shown a set screw 82 which is adjusted to move the pawl 80 into or out of engagement with a desired one of the serration teeth 78.

Figure 5:
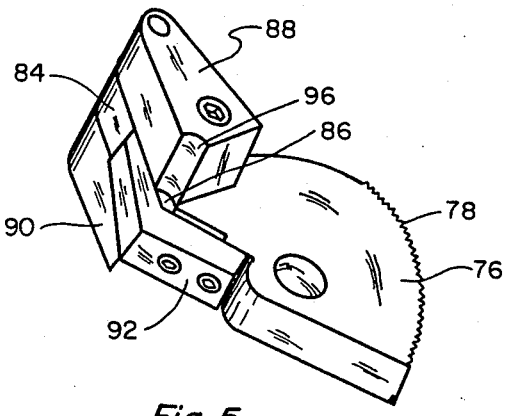
FIG. 5 is a perspective view of the band engaging assembly located on the fixed jaw portion of the subject device.

The member 76 includes an outwardly extending portion 84 which has a recess 86 (FIG. 5) formed in one side thereof to accommodate the roll pin 54 on one end of the flexible band 48. The member 76 also has attached to the portions 84 on opposite sides thereof similarly shaped wing members 88 and 90 which are provided to rest against the workpiece to help prevent angular or twisting movement thereof. A clamping plate 92 is attached to the member 76 by threaded member 94 which extends through the member 76 for cooperation with the clamping plate 92 as clearly shown in FIG. 7. When the threaded member 94 is tightened in its bore in the clamping plate 92, the clamping plate 92 bears against the roll pin 54 on the band end to lock it in position in the recess 86. The members 88 and 90 are shown having cutouts 96 (FIG. 5) which are similar in shape to the recess 84 to enable the roll pin 54 to be easily inserted into or removed from the recess 86 and permits various width bands to be used.

When the end portion of the band 48 in the roll pin 54 is locked in position on the member 76 as shown, the member 76 which is positioned between the plates 62 and 64 can in turn be locked in different setting positions by means of the pawl 80 and the serration teeth 78 as aforesaid. This is accomplished by loosening the pawl 80 using the threaded member 82, positioning the member 76 in the desired position taking into account the diameter of the workpiece to be held, and retightening the pawl 80 to lock the member 76 in fixed position on the assembly 44.

Figure 8:
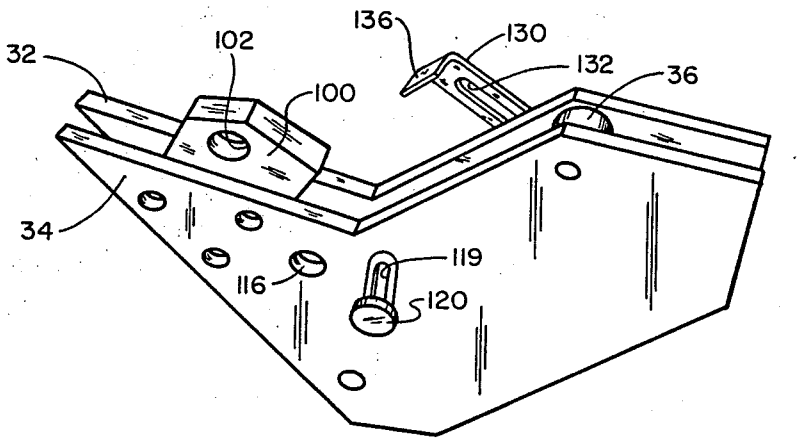
FIG. 8 is a perspective view of the portion of the subject device on which the fixed and movable assemblies are mounted.

FIG. 8 shows more of the details of the portions of the assembly 30 on which the assemblies 44 and 46 are mounted. The spaced wall members 32 and 34 are not only connected to opposite sides of the means which hold the mounting members 36 and 38 (FIG. 3) in position but are also connected together by a member 100 which is bolted therebetween and extends outwardly from one side thereof as shown. The member 100 has a bore 102 therethrough which is aligned with aligned bores 104 (FIG. 4) through the spaced plate members 62 and 64 of the assembly 44. The aligned bores 102 and 104 receive a pin 105 (FIG. 1) which allows limited angular movement of the assembly 44 relative to the structure 30 as clearly shown in FIGS. 1 and 2 where the assembly 44 is shown in its two operative positions under control of an actuating cylinder assembly 106. In FIG. 1 the cylinder assembly 106 is shown in its retracted condition which is the open non-gripping condition of the device and in FIG. 2, the cylinder 106 is shown in its actuated or extended condition which is the workpiece gripping and holding construction. As can be seen from these figures, the jaw assembly 44 moves through a relatively small angular displacement between its actuated and deactuated positions. In moving from its deactuated open condition to its actuated condition, however, it moves the connected end portion 54 of the band 48 a similar slight distance in order to locate that end of the band 48 in a position to best receive a workpiece in the curved portion of the band 48. The small amount of movement of the assembly 44 about the pivot 105 provides such clearance for an incoming or outgoing workpiece and also helps to form a more nearly round loop of the band 48 for the same reasons. The trunion member 74 which is pivotally connected to one end of the assembly 44 is shown connected to one end of a movable piston rod 108 which is part of the cylinder assembly 106. The opposite end of the piston assembly 106 is connected to a bifurcated extension 110 of the movable assembly 46.

FIG. 4 also shows the details of the movable assembly 46 which assembly includes an elongated body 112 of which the bifurcated extension 110 is a part. The body 112 has a cross bore 114 therethrough which when the assembly is positioned extending between the plates 32 and 34 of the assembly 30 is aligned with cross bore 116 (FIG. 8) which bore receives a journal pin 117 (FIG. 1). The assembly 46 moves about the pin 117 between its actuated and deactuated positions. Another pin or shaft 118 shown in FIG. 2 extends through aligned elongated slots 119 in the walls 32 and 34 and has a knob 120 (FIG. 8) on one end for locking it in any desired position in the slots 119. The pin 118 is included to engage the side edge 121 (FIG. 4) of the body 112 of the assembly 46 to limit angular travel thereof toward the deactuated open condition thereof. This is done to locate the associated band end portion 56 in the most desireable open position to receive a workpiece to be gripped. The knob 120 is provided to lock the pin 118 in a desired position.

In FIG. 4 the assembly 46 is shown having a curved hook shaped portion 122 which defines a rounded space 124 into which the hub end portion 56 of the band 48 is positioned as shown. The assembly 46 also has similar shaped spaced sidewardly extending portions 126 which are connected to a like shaped portion of the body 112 which forms the space 124 located extending from opposite sides thereof adjacent to the hook shaped portion 122. When the hub band portion 56 is positioned in the space 124, the band 48 extends outwardly therefrom as shown in FIG. 4 with the portions 126 extending sidewardly from opposite sides of the hub 56. When the assembly 46 is moved into a clamping position (FIG. 2) with the band 48 extending most of the way around a workpiece 52, the workpiece 52 will be adjacent to outer curved surface 128 of the portions 126 including the portion of the body 112 therebetween and in this way some limited pressure will be applied against the workpiece 52 and the band therearound in a direction to cause the band 48 to hold onto and grip the workpiece securely. Only a relatively small amount of pressure need be applied by the workpiece 52 against the outer curved surfaces 128 of the members 112 and 126 for this purpose, and this is an advantage because it is this feature that helps to make the present device interactive or self-locking on the workpiece. This means that only so much force as is required will be used to maintain this condition and this force will be relatively small.

When the piston assembly 106 is moved from its retracted to its extended condition the piston will move against the body portion 110 of the movable assembly 46 and against the trunion 74 on the assembly 44 moving the assemblies apart about their respective pivots, and causes both assemblies to pivot somewhat but in opposite directions. The assembly 46 moves a much greater angular distance about the journal 116 than does the assembly 44 about its pivot 102 (FIG. 8) thereby moving the band end portion 56 a further distance toward the opposite band end portion 54 to grip the workpiece and hold the workpiece in a secure position.

It should be recognized that the position and shape of the band 48 as it extends between the assemblies 44 and 46 does not change substantially in going from its open or non-gripping condition to its closed or gripping condition. The important thing is that in the open condition, it be adjusted to be able to receive a workpiece and it must be able to grip a workpiece when drawn tight in its closed condition and this be accomplished with minimal force being required in the process. This also means that when the workpiece 52 is brought into alignment with the space defined by and within the loop portion of the band 48 (and with a mandrel or other machine tool for operating on the workpiece), that the workpiece be able to be moved into the space defined within the band where upon actuation of the cylinder 106 to its extended condition will cause the band 48 to grip the workpiece and hold the workpiece in proper position for moving onto the mandrel or other machine tool and supporting the workpiece while being operated on and if necessary held while being stroked. When so held the subject gripping and holding fixture will be able to withstand substantial amounts of torque while holding the workpiece in firm and accurate condition. However, as pointed out, it may be necessary to adjust the length of the band 48 that extends between the jaws 44 and 46 to accommodate different diameter workpieces. To do this requires the use of a screwdriver (or a suitable wrench) that engages the slot 60 in the hub end portion 56 of the band 48. With the screwdriver positioned in the slot 60, the hub member 56 can be rotated in either desired direction to rotate the hub 56 in the rounded space 124. This is done to wind up or pay out a desired length of the band 48 as required.

Since the fixed and movable jaw assemblies 44 and 46 are both mounted on the same support structure 30, and since the support structure 30 can easily and quickly be installed on or removed from a fixed support structure 22 as shown in FIG. 1 simply by lifting it out or setting it in place, it is possible to employ several assemblies similar to the assemblies 30 with their jaws 44 and 46 preadjusted when going from one job to another in rapid succession.

Figure 3:
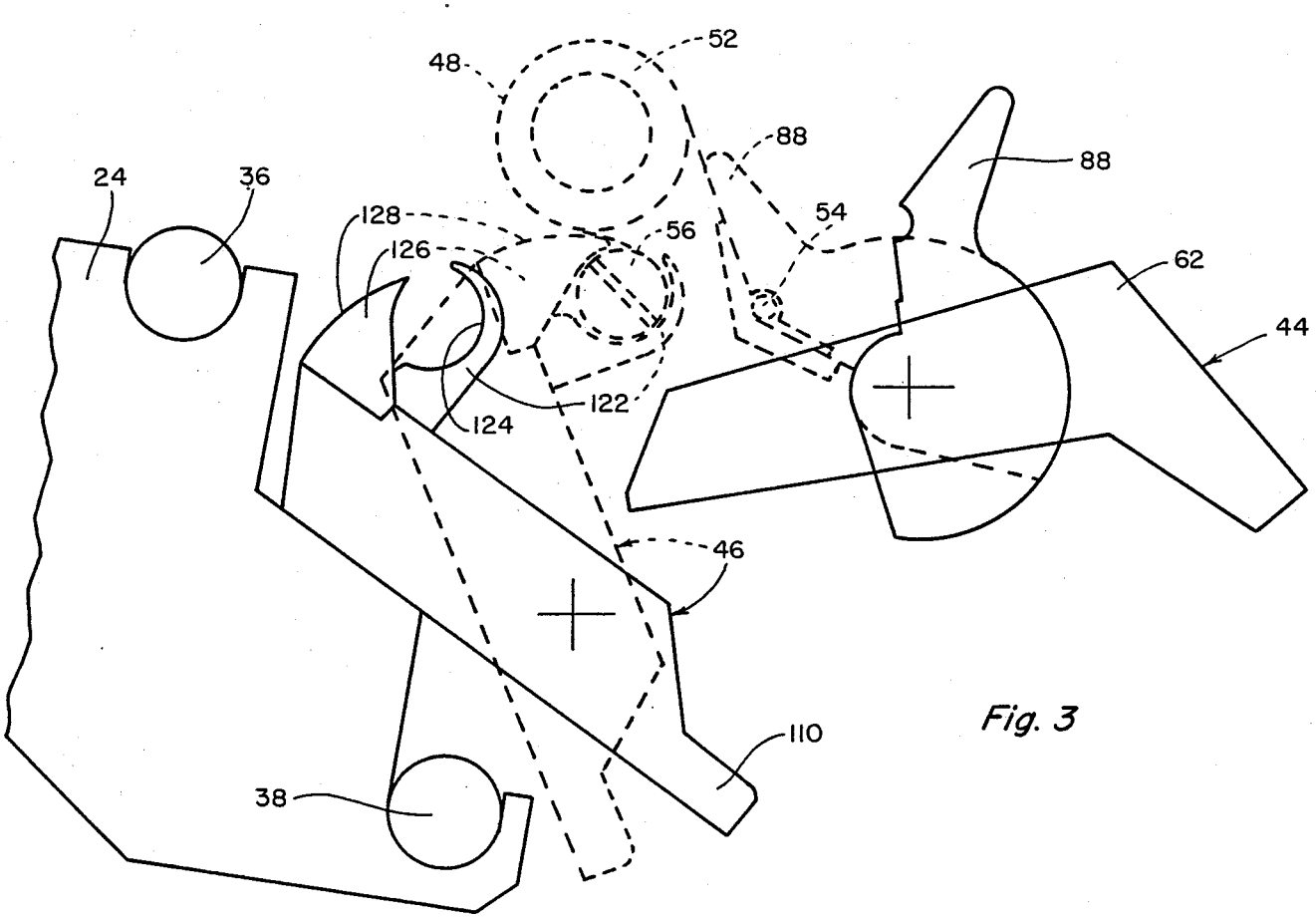
FIG. 3 is a diagramatic side elevational view showing in solid and dotted outline several different positions of adjustability for one portion of the subject device to accommodate different size workpieces.

FIG. 3 shows the jaws 44 and 46 in several different positions for ease of understanding. It should be noted in connection with the jaw 44 that it should be adjusted as shown in dotted outline such that the end portion of the band extends in a smooth configuration from the groove 78 where the pin 54 is attached along the member 84 onto the workpiece 52.

An optional band positioning member 130 of L-shape is attached to one side of the plate 32 (or 34) by means of an elongated slot 132 and threaded fastener 134. The member 130 has a leg portion 136 which is adjusted to be positioned adjacent to one side of the band 48 (FIG. 1) in position to act as a backstop for the band and to maintain the band in position to receive a workpiece.

It is anticipated that the subject device can be timed by suitable control means for operating the hydraulic or other operator means 106 in synchronism with a workpiece loading and supporting magazine structure such as that disclosed in copending Sunnen et al U.S. patent application Ser. No. 098,549. If this is done then as each workpiece moves into position to be gripped by the subject assembly, the assembly will be moved axially along suitable guide rails, not shown, to receive the workpiece in the space defined by the band 48 where upon the cylinder 106 will be activated to grip the workpiece and move it from the magazine feed means to its honing or machining position again on guide rails or the like. The reverse will occur when the honing or machining operation is completed.

Thus there has been shown and described novel means for gripping and holding a workpiece while it is being operated on which fulfills all of the objects and advantages sought therefor. It will be apparent to those skilled in the art, however, that many changes, modifications, variations and other uses and applications of the present device are possible, and all such changes, modifications, variations and other uses and applications which do not depart from the spirit and scope of the invention are deemed to be covered by the invention which is limited only by the claims which follow.

I claim:

1. Means for gripping and holding the outer surface of a workpiece comprising a support structure, a relatively stiff but flexible band having first and second spaced opposite end portions and capable of retaining and of re-assuming substantially the same curved loop size, shape and position between the end portions each time the end portions are moved to the same relative positions, a first assembly pivotally mounted on the support structure including means thereon for attaching thereto the first opposite end portion of the flexible band, a second assembly pivotally mounted on the support structure spaced from the first assembly including means for attaching thereto the second opposite end portion of the band, the loop portion of the band extending upwardly from said first and second assemblies, one of the said first and second assemblies being mounted on the support structures for greater pivotal movement than the other, the assemblies including the band end portions attached thereto being pivotally movable between first and second positions relative to each other to change the size and shape of the space defined by and within the loop shaped band portion whereby the band can move into or out of engagement with the outer surface of a workpiece to be gripped and supported thereby, the shape and position of the loop portion of the band repeating each time the assemblies move to positions in which the band is out-of-engagement with the workpiece, and means associated with the one of said first and second assemblies for maintaining the associated band end portion engaged with the outer surface of the workpiece in one position thereof.

2. The means for gripping and holding a workpiece of claim 1 wherein the flexible band is formed of a spring steel having a layer of particles of an abrasive material formed on one surface thereof.

3. The means for gripping and holding a workpiece of claim 1 including means on at least one of said first and second assemblies for attaching to the corresponding band end that are adjustable to change the length of the flexible band extending between the first and second assemblies.

4. The means for gripping and holding a workpiece of claim 1 including operator means connected between the first and second assemblies for simultaneously pivoting the assemblies in opposite angular directions on the support structure.

5. The means for gripping and holding a workpiece of claim 1 including means on one of said first and second assemblies adjustable to relocate the end of the flexible band that is attached thereto.

6. The means for gripping and holding a workpiece of claim 1 including a machine tool having a work engaging portion rotatable about an axis mounted thereon, means for mounting the support structure on the machine tool including means to enable moving the support structure axially relative to the work engaging portion of the machine tool.

7. The means for gripping and holding a workpiece of claim 6 wherein the machine tool is a honing machine having a mandrel rotatable about an axis mounted thereon, and means on the honing machine for mounting the support structure including means for producing relative axial movement between the support structure and the honing mandrel.

8. The means for holding a workpiece of claim 1 wherein the means attaching one of the ends of the flexible band includes a support member and means for moving the band end relative thereto to adjust the length of band extending between the first and second assemblies.

9. The means for gripping and holding a workpiece of claim 1 wherein one end portion of the flexible band has affixed thereto mean for attaching the band to the first assembly.

10. The means for gripping and holding a workpiece of claim 1 wherein both end portions of the flexible band have affixed thereto means for engaging to the respective first and second assemblies.

11. A holding fixture for supporting workpieces on a machine having a working member rotatably mounted thereon, means for rotating the working member about an axis of rotation, a fixture mounting assembly for supporting and holding a workpiece holding fixture in position to be engaged by the working member, the improvements residing in a holding fixture including a support structure for mounting on the fixture mounting assembly in position extending transversely to the axis of rotation of the working member, spaced first and second assemblies pivotally mounted on the support structure, an elongated relatively stiff but resilient metal band having spaced opposite end portions, said band being constructed of a metal material capable of being formed into a curved shape, means for attaching respective opposite end portions of the band to the first and second assemblies whereby a portion of the band extending therebetween is maintained in an arcuately curved loop condition extending upwardly from the first and second assemblies in position to receive and to engage a workpiece positioned therein, means on at least one of the first and second assemblies for adjusting the position of the band attachment means thereat to change the shape of the band extending between the first and second assemblies, and means for moving said first and second assemblies on the support structure to change the positions of the corresponding attached end portions of the band to move the band between an open and closed condition to respectively receive and to engage a workpiece positioned in the arcuately curved portion of the band.

12. A fixture for holding a workpiece while a surface thereon is honed by a honing machine having a honing mandrel mounted for rotation about a honing axis, means for rotating the mandrel, and means on the honing machine for mounting the workpiece holding fixture, the improvements residing in a holding fixture having a support structure including means for mounting the support structure on the honing machine in position extending transversely relative to the axis of rotation of the honing mandrel, first and second spaced assemblies pivotally mounted on the support structure, an elongated relatively stiff but flexible band having first and second opposite end portions and a loop portion extending therebetween, means for attaching the said first and second band end portions to the respective first and second assemblies with the loop portion thereof extending upwardly therefrom, and means for pivotally moving the first and second assemblies on the support structure to change the spacing between the means attaching the first and second band end portions to change the shape of the loop portion of the band extending therebetween, the size, shape and location of the loop portion repeating themselves each time the first and second assemblies are moved to at least one of their relative positions.

13. The fixture of claim 12 including socket in one of the assemblies and means on the band for engaging said socket adjustable thereon to change the length of the band extending between the spaced band end portions.

14. The fixture of claim 13 including means to adjust the orientation of the socket on at least one of the assemblies to change the orientation at which the associated end of the band extends therefrom.

15. The fixture of claim 12 including an actuator assembly formed by relatively movable first and second portions one of which is connected to the first assembly and the other to the second assembly.

16. The fixture of claim 15 wherein one of the said assemblies is angularly moveable on the support structure to a much greater extent than the other.

* * * * *

UNITED STATES PATENT OFFICE

CERTIFICATE OF CORRECTION

Patent No. 4,827,674 Dated May 9, 1989

Inventor(s) Frank E. Vanderwal, Jr. and Robert M. Sunnen

It is certified that error appears in the above-identified patent and that said Letters Patent is hereby corrected as shown below:

Column 8, line 17, "structures" should be --structure--.

Column 9, line 5, "mean" should be --means--.

Signed and Sealed this

Twenty-seventh Day of February, 1990

*Attest:*

JEFFREY M. SAMUELS

*Attesting Officer* *Acting Commissioner of Patents and Trademarks*